US005082094A

United States Patent [19]

Nechushtan

[11] Patent Number: 5,082,094

[45] Date of Patent: Jan. 21, 1992

[54] EXPANDABLE CASE

[76] Inventor: Gabriel Nechushtan, 5 Tchelenov St., Rishon Lezion 75234, Israel

[21] Appl. No.: 536,781

[22] Filed: Jun. 12, 1990

[30] Foreign Application Priority Data

Sep. 4, 1989 [IL] Israel ..... 91505

[51] Int. Cl.[5] ..... A45C 7/00; A45C 13/00; A45C 13/02

[52] U.S. Cl. ..... 190/105; 190/22; 190/107; 220/4.28; 220/8

[58] Field of Search ..... 190/13 R, 14, 21, 103–105, 190/107, 119, 22; 220/8, 4.28–4.33

[56] References Cited

U.S. PATENT DOCUMENTS

| | | | |
|---|---|---|---|
| 16,336 | 1/1857 | Loewenberg | 190/22 |
| 587,487 | 8/1897 | Palica | 190/22 |
| 764,144 | 7/1904 | McGowan | 190/105 |
| 1,241,210 | 9/1917 | Harvey | 190/104 |
| 2,416,142 | 2/1947 | Bennett | 220/8 X |
| 2,475,961 | 7/1949 | Hilbert | 190/105 |
| 2,699,848 | 1/1955 | Kaplan | 190/105 |
| 3,316,460 | 4/1967 | Scoville | 220/4.33 X |
| 3,738,358 | 6/1973 | Hallet | 128/85 |
| 3,738,458 | 6/1973 | Yount | 190/119 X |
| 3,837,548 | 9/1974 | Nerger | 220/8 X |
| 4,630,717 | 12/1986 | Tong | 190/104 |
| 4,693,346 | 9/1987 | Eversdijk | 190/111 |
| 4,787,488 | 11/1988 | Campanini | 190/104 |
| 4,844,215 | 7/1989 | Ambasz | 190/105 |
| 4,854,430 | 8/1989 | Peterson | 190/105 |

FOREIGN PATENT DOCUMENTS

| | | | |
|---|---|---|---|
| 131812 | 8/1952 | Austria | 190/22 |
| 79395 | 5/1983 | European Pat. Off. | 190/122 |
| 211975 | 3/1987 | European Pat. Off. . | |
| 2342895 | 3/1975 | Fed. Rep. of Germany | 190/110 |
| 2615447 | 10/1977 | Fed. Rep. of Germany . | |
| 401353 | 8/1909 | France | 190/21 |
| 11288 | 11/1909 | France | 190/21 |
| 405426 | 12/1909 | France | 190/21 |
| 2233010 | 1/1975 | France | 190/104 |
| 648282 | 10/1962 | Italy | 190/103 |
| 1261618 | 10/1986 | U.S.S.R. | 190/104 |
| 17814 | of 1900 | United Kingdom | 190/22 |
| 20796 | of 1903 | United Kingdom | 190/21 |
| 11502 | of 1912 | United Kingdom | 190/22 |
| 248132 | 3/1926 | United Kingdom | 190/21 |
| 2079255 | 1/1982 | United Kingdom . | |

*Primary Examiner*—Sue A. Weaver
*Attorney, Agent, or Firm*—Leonard Bloom

[57] ABSTRACT

A case including side wall portions and a central frame portion, and substantially rigid means on the side wall portions adapted to engage substantially rigid complementary means on the central frame portion, the side walls being adapted to move a predetermined distance relative to the central frame portion so as to expand the case to one of a plurality of substantially predetermined case sizes.

7 Claims, 5 Drawing Sheets

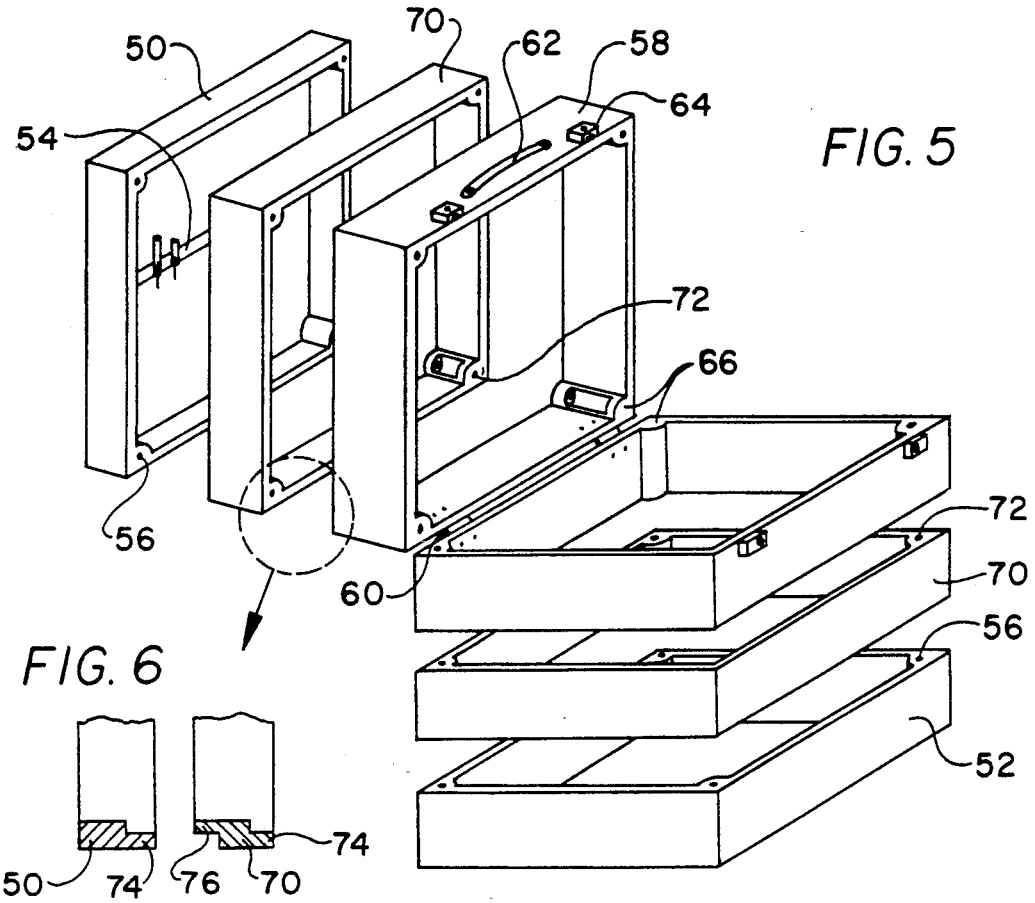
FIG. 5
FIG. 6
FIG. 7a
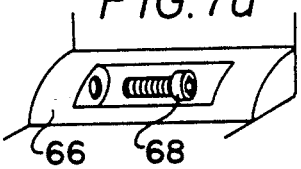
FIG. 8a FIG. 8b FIG. 8c
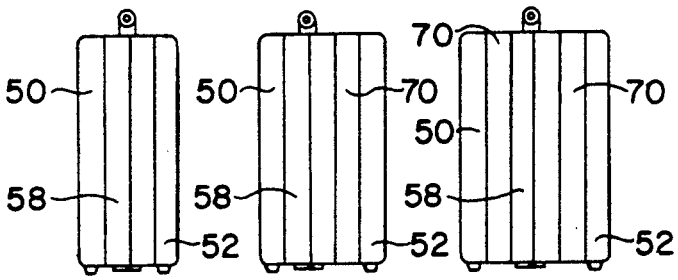
FIG. 7b
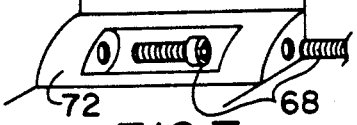
FIG. 7c
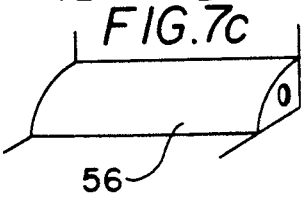

EXPANDABLE CASE

FIELD OF THE INVENTION

The present invention relates to hand luggage in general and, in particular, to expandable suitcases and the like.

BACKGROUND OF THE INVENTION

Suitcases, briefcases, and other hand carried luggage are generally manufactured in a variety of sizes and volumes. Collapsible suitcases, wherein it is possible to remove one or more walls of the suitcase for convenience in transportation, are known. These suitcases may include walls which are retained in place by friction, or those retained within grooves defined in the outer frame. See, for example, GB 2,079,255A, U.S. Pat. No. 3,738,468, and DE 26 15 447. These cases can all be collapsed, but none of them is adapted to be expanded beyond a single basic size, in case of need.

There are also known briefcases having several walls folded in accordion folds which are capable of flattening out when the case is filled so as to increase the volume therein. These folds are a weak point of the case, the case not having a substantially rigid central portion for carrying objects.

SUMMARY OF THE INVENTION

It is therefore an object of the present invention to provide a case which is readily expandable all around the perimeter to one of a number of different sizes, which is easy to assemble and expand, and inexpensive to manufacture.

There is thus provided in accordance with the present invention a case including side walls and a central frame portion, and substantially rigid elements on the side walls adapted to engage substantially rigid complementary elements on the central frame portion, the side walls being adapted to move a predetermined distance relative to the central frame portion so as to expand the case to one of a plurality of substantially predetermined case sizes.

There is further provided in accordance with the present invention an expandable case including at least one removable side end portion, the open edge of the removable side end portion defining a peripheral projecting rib, a bottom central portion defining along at least one side thereof a plurality of rib receiving tracks, and a top central portion defining along at least one side thereof a plurality of rib receiving tracks in registration with the tracks of the bottom central portion, the projecting rib being arranged for selectable seating in the rib receiving tracks of the top and bottom central portions.

According to a preferred embodiment, the top central portion defines a flange arranged to overlap the bottom central portion in the assembled case.

According to one embodiment, the non-removable side end portion includes hinge elements to which the bottom central portion is affixed and closure elements arranged to engage complementary closure elements on the top central portion.

According to a preferred embodiment, the case includes two removable side end portions, each defining a peripheral projecting rib, the bottom central portion includes two portions coupled by hinge elements, each portion defining a plurality of rib engaging tracks along its non-hinged side, the case further comprising a second top central portion defining a plurality of rib engaging tracks along one side thereof, the first and second top central portions being provided with complementary closure elements on their sides which do not define tracks.

Further according to the present invention, there is provided an expandable case comprising two side end portions, a hinged central portion including closure elements, and at least one spacer element arranged for selective disposition between an end portion and the central portion, the side end portions, central portions and spacer elements all including coupling elements disposed in registration with one another. According to a preferred embodiment, the coupling is achieved by means of screws and holes.

According to a preferred embodiment, the inner edge of each portion defines a lip which is arranged to overlap a shoulder defined on the outer edge of the adjacent portion.

Further according to a preferred embodiment, the case comprises a plurality of spacer elements.

According to an alternate embodiment of the invention, each side portion is telescopingly mounted within the central portion and arranged for sliding movement relative thereto to expand or contract the volume of the case.

BRIEF DESCRIPTION OF THE DRAWINGS

The present invention will be further understood and appreciated from the following detailed description taken in conjunction with the drawings in which:

FIG. 5 is an exploded perspective view of a case constructed and operative in accordance with an alternate embodiment of the present invention;

FIG. 6 is a sectional view of a detail of the case of FIG. 5;

FIGS. 7*a*, 7*b* and 7*c* are additional details of the case of FIG. 5;

FIGS. 8*a*, 8*b* and 8*c* are end views of a case of the present invention in non-expanded, asymmetrically expanded and symmetrically expanded orientations;

DETAILED DESCRIPTION OF THE INVENTION

The present invention relates to briefcases, suitcases and other similar luggage which is expandable from its basic size to a plurality of greater volumes. The case comprises side walls and a central frame portion, and substantially rigid means on the side walls adapted to engage substantially rigid complementary means on the central frame portion, the side walls being adapted to move a predetermined distance relative to the central frame portion so as to expand the case to one of a plurality of substantially predetermined case sizes.

The cases of the present invention may be substantially rigid all around. Alternatively, the side walls may be formed of vinyl, fabric or other conventional material, so long as the connecting elements are substantially rigid to provide a solid connection. The cases of the present invention may be provided with lining and inside pockets, as known in conventional cases.

It will be appreciated that there are any number of designs of cases falling within the general invention. The invention will be described hereinbelow with reference to three specific embodiments. It will be appreciated however, that the invention is not limited thereto.

Figure 1:
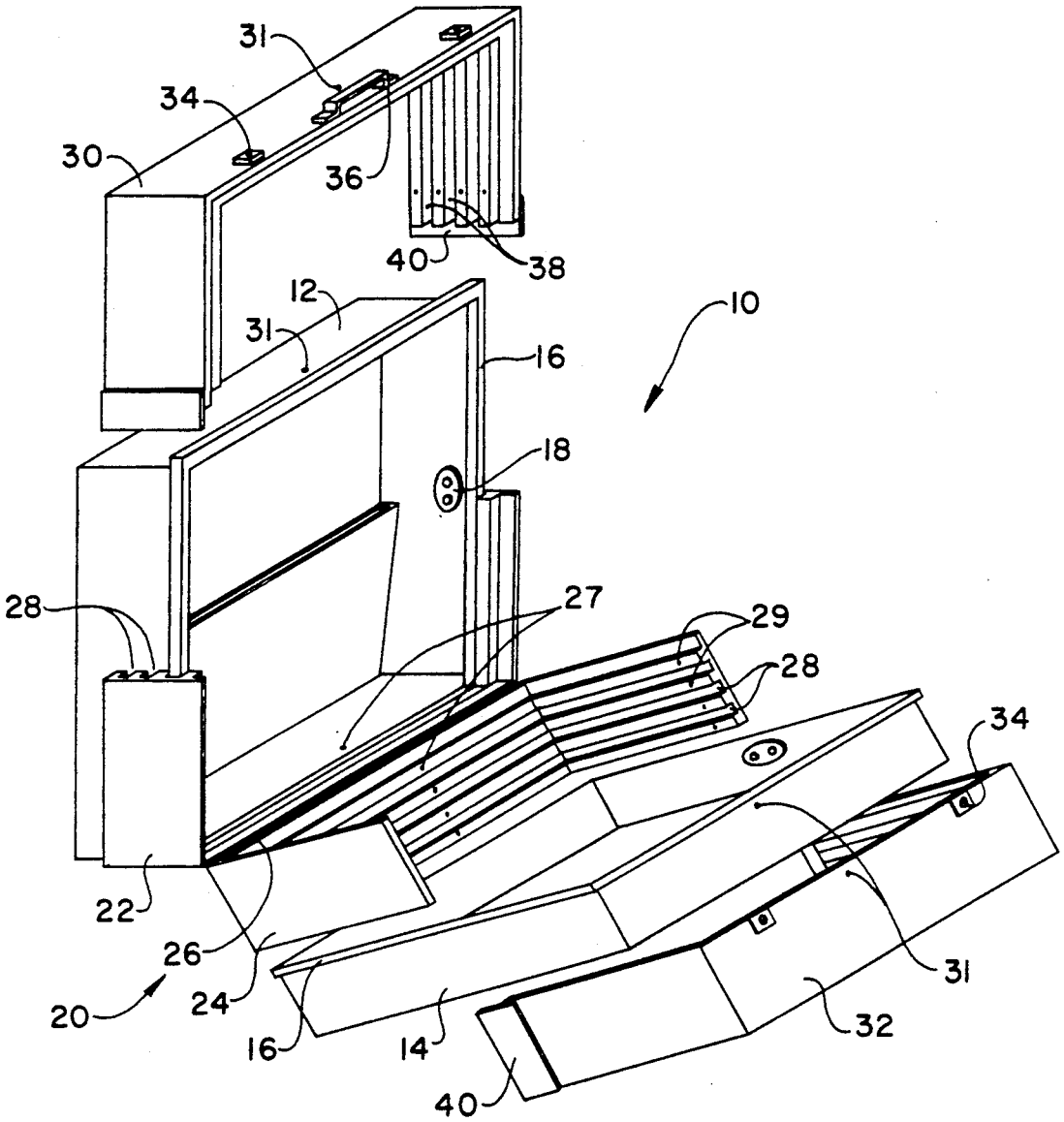
FIG. 1 is an exploded perspective view of a case constructed and operative in accordance with one embodiment of the present invention.
Figure 3A:
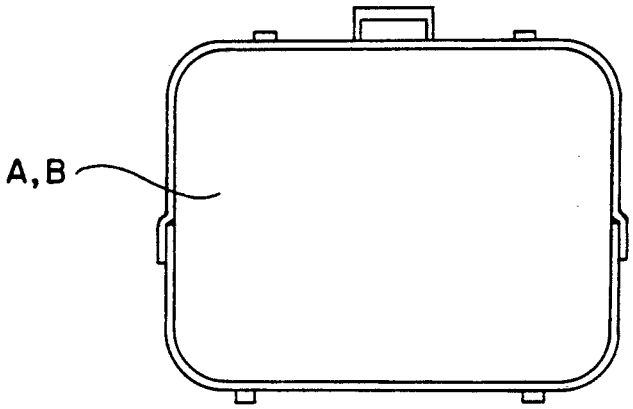
FIGS. 3*a* and 3*b* are side views of the case of FIG. 1 in respective unexpanded and expanded orientations.
Figure 2A:
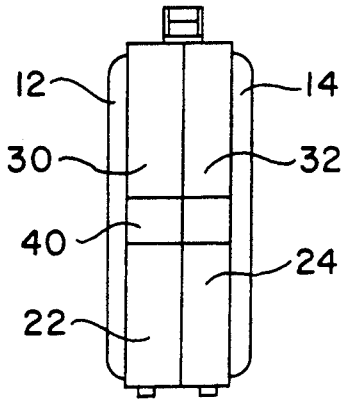
FIGS. 2*a* and 2*b* are top views of the case of FIG. 1 in respective unexpanded and expanded orientations.
Figure 2B:
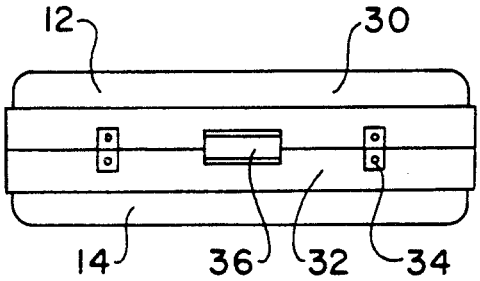
Figure 2B:
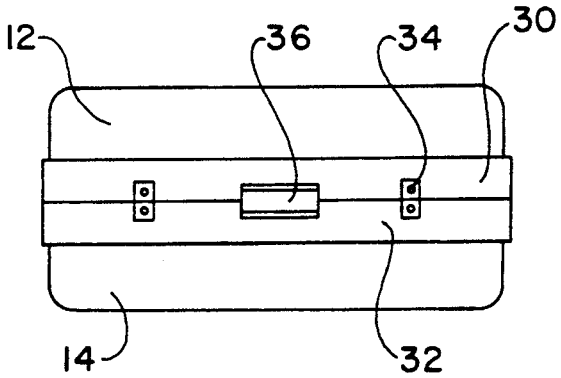
Figure 3B:
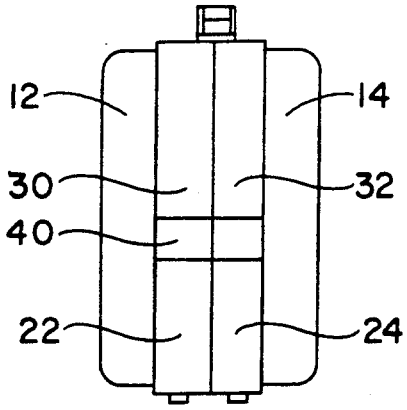

With reference to FIG. 1, there is shown an exploded perspective view of a case 10 constructed and operative in accordance with one embodiment of the present invention. Case 10 comprises first and second side end portions 12 and 14. The open edges of side end portions 12 and 14 each define a peripheral projecting rib 16. Adjacent rib 16 is mounted locking means 18, which may comprise a plurality of screw holes and a reinforcement plate.

Case 10 further comprises a bottom central portion 20. In the illustrated embodiment, bottom central portion 20 comprises two halves 22 and 24 joined by hinge means 26, as known. The interior of bottom central portions 22, 24 defines a plurality of rib receiving tracks 28. Any number of tracks 28 may be provided, the number of tracks defining the number of different stages of expansion possible. Each of tracks 28 defines locking means 29, such as screw holes and a reinforcing plate, arranged to be in registration with locking means 18, as described hereinbelow.

Two top central portions 30 and 32 are also provided. Top central portions 30 and 32 define case closure elements 34 and a handle 36, as on conventional cases. The interior of top central portions 30 and 32 defines a plurality of rib receiving tracks 38. Rib receiving tracks 38 are arranged to be in registration with rib receiving tracks 28. Any number of tracks 38 may be provided, provided that there are the same number as are provided on bottom central portions 22 and 24.

Figure 4A:
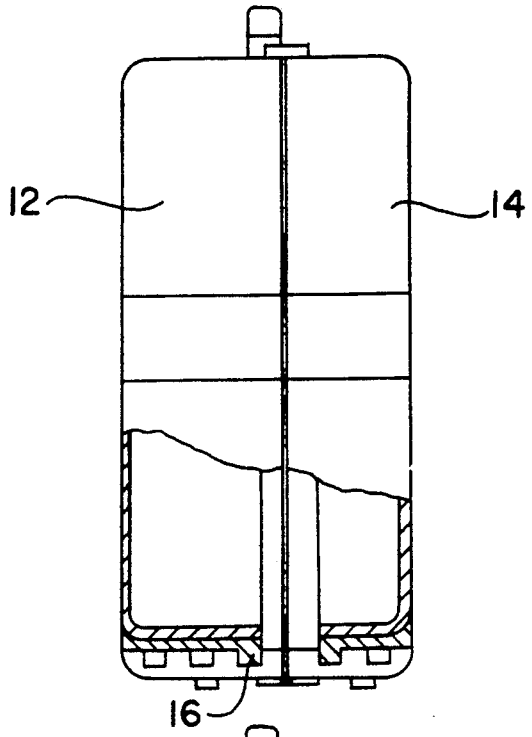
FIGS. 4*a* and 4*b* are sectional views of the case of FIG. 1 in respective unexpanded and expanded orientations.
Figure 4B:
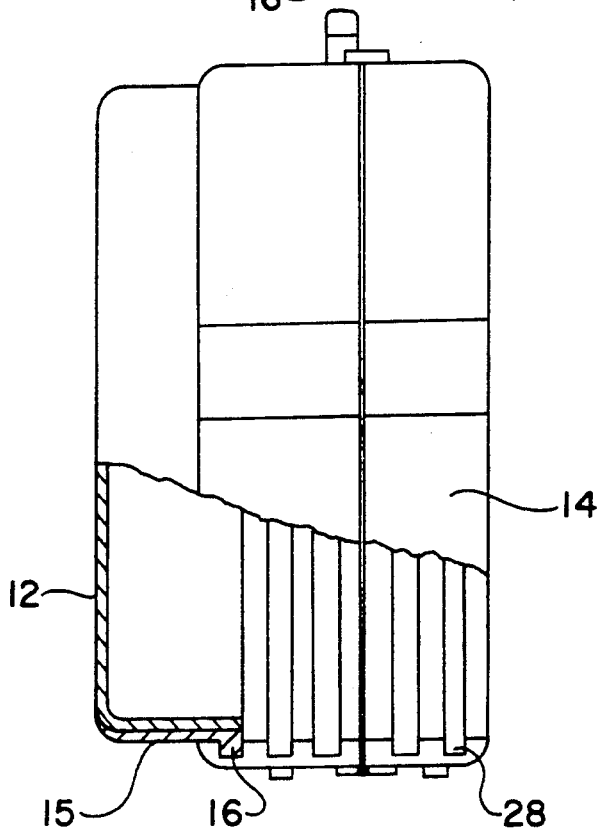

It will be appreciated that the case consisting of only one expandable side, as shown in FIG. 4*b*, is also within the present invention. In this case, the second, non-extendable, side end portion would be integrally formed with one of the top and bottom central portions, which would, therefore, require no rib receiving tracks. This integral side portion would include case closure elements and hinge means adapted to engage the tracked top and bottom central portions of the expandable part of the case.

According to a preferred embodiment, top central portions 30 and 32 each define a flange 40 arranged to overlap the bottom central portion in the assembled case. Flange 40 serves to seal the case and prevent the entrance of rain water, etc.

In the embodiment illustrated in FIG. 1, the ribs 16 and tracks 28 and 38 are shown as having a square or rectangular cross-section. According to an alternate embodiment, ribs 16 define a trapezoidal cross-section and tracks 28 and 38 define complementary trapezoidal tracks. This construction permits improved fit and locking of the ribs in the tracks.

Operation of the case of the present invention is as follows, with additional reference to FIGS. 2*a*, 2*b*, 3*a*, 3*b*, 4*a* and 4*b*. The case is constructed by sliding the projecting rib 16 of side end portion 12 into one of tracks 28 on the bottom central portion 22 and the rib 16 of side end portion 14 into one of tracks 28 on bottom central portion 24 and affixing them at 27. Top central portion 30 is then slid with the corresponding track 38 engaging rib 16 of side end portion 12, i.e., the track 38 which is complementary to track 28 of the bottom portion. Top central portion 32 is then slid likewise with the complementary track 38 engaging rib 16 of side end portion 14. The top portions are affixed to the side end portions at 31.

The top and bottom central portions are now locked to the side end portions by any suitable locking means 18, such as nuts and bolts through screw holes, or any other means.

According to a preferred embodiment of the invention, as seen in FIGS. 4*a* and 4*b*, a metal reinforcing plate 15 is provided along the outer perimeter of the side end portions integral with the projecting rib 16.

The suitcase produced in this manner can be opened and closed and filled as known with any conventional suitcase. When it is desired to expand or contract the suitcase, the same procedure is followed, however ribs 16 are moved into engagement with different tracks 28 and 38.

Referring now to FIG. 5 there is shown an alternate embodiment of the expandable suitcase of the present invention. This suitcase comprises first and second side end portions 50 and 52 which may include a pocket 54, as known. The corners of side end portions 50 and 52 define assembly means 56, herein illustrated as screw holes 56.

The suitcase further comprises a hinged central portion 58 with hinges 60, handle 62 and closure means 64, all as known. Central portion 58 also defines assembly means 66 in its corners, in registration with assembly means 56 of the side end portions. Screws 68 passing through screw holes 56 and 66 in each half of the suitcase serve to hold the case together.

In its smallest version, the suitcase consists only of side end portions 50 and 52 affixed via assembly means 56 and 66 to central portion 58.

When it is desired to expand the suitcase, at least one spacer element 70 is inserted between one of the side end walls 50 or 52 and the central portion 58. Spacer element 70 also includes assembly means 72 in registration with those in the end and central portions, which may also consist of screw holes and complementary screws.

Expansion of the suitcase of this embodiment is limited only by the assembly means. Any number of spacer elements may be inserted on either or both halves of the suitcase, as desired.

One example of assembly means is illustrated in FIGS. 7*a*, 7*b* and 7*c* which illustrate assembly elements for mounting on he central portion 58, a spacer element, 70 and a side wall 52, respectively. As seen, conventional screws can be utilized to couple these elements to one another. Alternatively, any other assembly means permitting easy and rapid coupling and release may be utilized.

According to a preferred embodiment, shown schematically in FIG. 6, the inner edges of the side end portions 50, 52 and spacer elements 70 define a lip 74 arranged to overlap a corresponding recess 76 in the outer edges of the spacer elements 70 and central portion 58. This serves to seal and stabilize the case and to prevent the entrance of rainwater, etc.

It will be appreciated by those skilled in the art that the suitcases of the present invention need not be expanded symmetrically. Rather, it is possible that only one side of the suitcase would be expandable o would be expanded at any given time. An example is provided in FIGS. 8*a*, 8*b* and 8*c* which show a non-expanded case, case with one spacer element and a case with two spacer elements, respectively.

Figures 9, 10, 11:
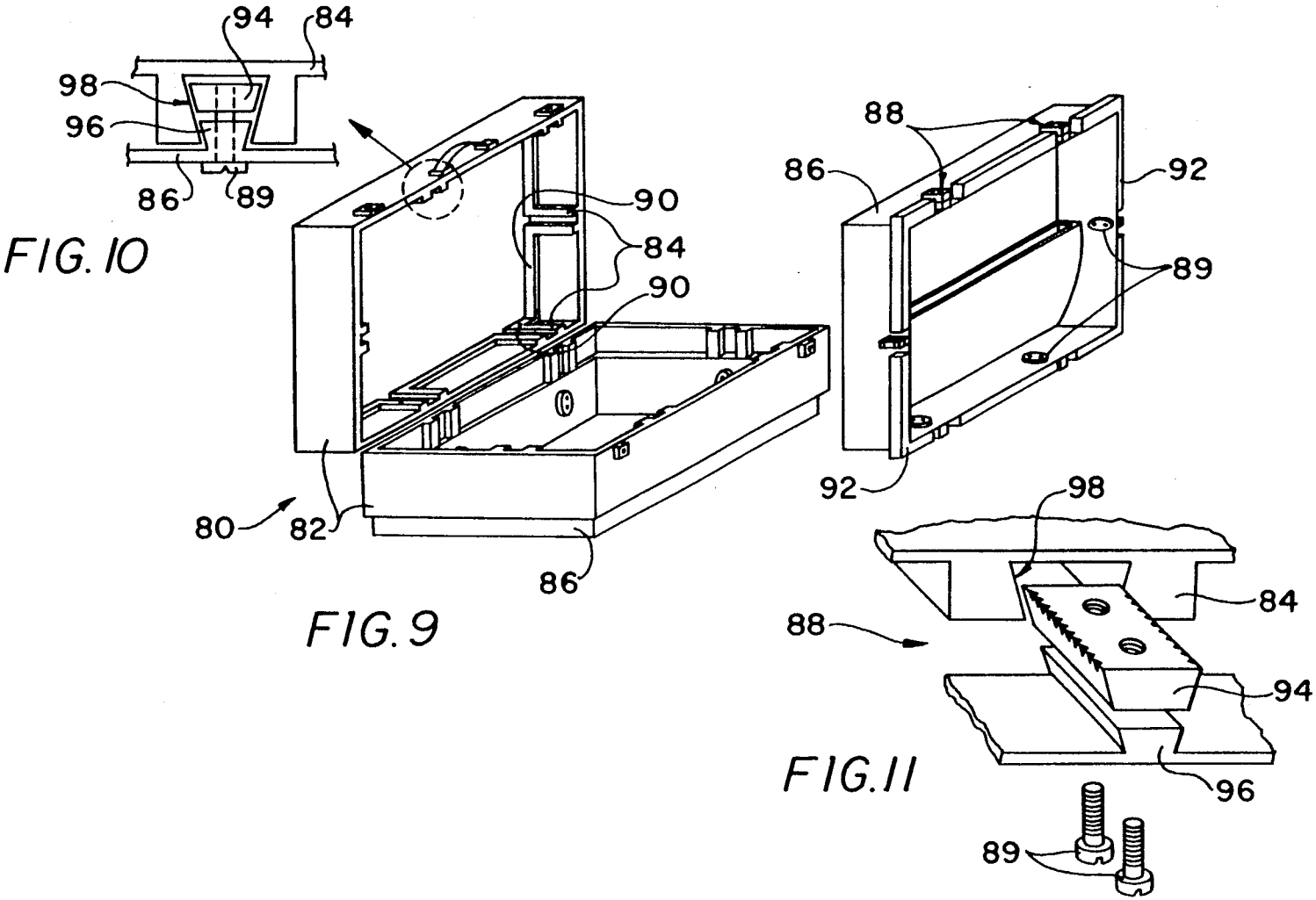
FIG. 9 is an exploded perspective view of a case constructed and operative in accordance with an alternate embodiment of the present invention.
FIG. 10 is a sectional view of a detail of one embodiment of the case of FIG. 9
FIG. 11 is a perspective view of the detail of FIG. 10.

Referring now to FIG. 9 there is shown a case 80 constructed and operative in accordance with yet another embodiment of the present invention. Case 80 comprises a substantially rigid central portion 82 which is hinged as known and provided with closure means and a handle. A plurality of track elements 84 are provided on the interior surface of central portion 82.

Case 80 further comprises two side end portions 86 of slightly smaller dimensions than the central portion. Side end portions 86 are adapted to fit within the central portion and to slide telescopically outward therefrom. Accordingly, the side end portions 86 are provided on their outer surface with a plurality of rib members 88 which are adapted to slidingly engage track elements 84.

Track elements 84 define a peripheral shoulder 90 and side end portions 86 define a peripheral flange 92. Flange 92 and shoulder 90 act as stop members to prevent the side end portion from sliding completely out of the central portion.

Operation of this embodiment is as follows. In the collapsed orientation (basic size of the case), the central portions substantially overlap the side end portions, which are locked in place to prevent inadvertent expansion of the case. When it is desired to expand the case, the side end portions are unlocked and slid telescopically outwards from the central portion until the desired volume has been reached. The side end portions are then locked in the new orientation.

Any suitable means for locking the side end portions relative to the central portions can be utilized. According to one embodiment of the invention, shown in FIGS. 10 and 11, track elements 84 define a trapezoidal cross section and rib members 88 define a complementary trapezoidal cross section. In the illustrated embodiment, rib 88 comprises an inner portion 94 and an outer portion 96 coupled to one another by screws 89. Tightening of screws 89 pulls inner portion 94 toward outer portion 96 and causes inner portion 94 to engage the side walls 98 of track element 84. This embodiment does not require screw coupling through the track element. Preferably, the side edges of the rib 88 are knurled to increase the friction fit.

It will be appreciated by those skilled in the art that the invention is not limited to what has been shown and described hereinabove by way of example. Rather, the scope of the invention is limited solely by the claims which follow.

I claim:

1. A case comprising:

a substantially rigid central frame portion defining at least one side-facing open edge and a plurality of substantially parallel rib-receiving tracks substantially parallel to the open edge of the case;

at least one movable side compartment defining a substantially rigid rib extending peripherally therefrom and dimensioned for slidable engagement within said rib-receiving tracks and arranged for selectable engagement within any one of said rib-receiving tracks in such a way that none of the tracks is exposed outside the compartment;

wherein said at least one side compartment is movable with respect to said central portion from one rib-receiving track to another to obtain a desired volume.

2. An expandable case having a volume, the case comprising:

a bottom central portion defining an open side facing edge along at least one side thereof with a plurality of substantially parallel rib receiving tracks parallel to said open side facing edge;

a top central portion defining an open side facing edge along at least one side thereof with a plurality of substantially parallel rib receiving tracks parallel to said open side facing edge and in registration with the tracks of the bottom central portion; and at least one movable side compartment, an open edge of the movable side compartment defining a peripheral projecting rib dimensioned for slidable engagement in said rib receiving tracks of the top and bottom central portions, wherein said at lest one side compartment is movable with respect to said top and bottom central portions from one rib receiving track to another to obtain a desired volume.

3. A case according to claim 2 and wherein the top central portion defines an overhanging lip arranged to overlap at least a portion the bottom central portion in the assembled case.

4. A case according to claim 2, wherein said at least one movable side compartment comprises two movable side compartments, wherein said top central portion and said bottom central portion each define two open side-facing edges along opposite sides thereof and a plurality of rib receiving tracks substantially parallel to each of said open edges along both said edges, each of said side compartments defining a peripherally projecting rib dimensioned for slidable engagement in said tracks, one on either side of the top and bottom central portions;

wherein the side compartments are movable with respect to one another from one rib receiving track to another to obtain a desired volume.

5. A case according to claim 4 and wherein:

the bottom central portion comprises two portions coupled by hinge elements, each portion defining said plurality of rib receiving tracks along its non-hinged side; and said top central portion consists of two portions, each portion defining said plurality of rib receiving tracks along one side thereof and being provided with complementary closure elements on their sides which do not define tracks.

6. A case according to claim 2, and wherein said bottom central portion and said top central portion define said rib receiving tracks on aid one side thereof, the other side of each merging into a non-movable side compartment.

7. A case according to claim 2 and wherein:

the bottom central portion comprises two portions coupled by hinge elements, at least one of said portions defining said plurality of rib receiving tracks along its non-hinged side; and said top central portion consists of two portions couplable by complementary closure elements, at least one of said portions defining said plurality of rib receiving tracks along the side thereof not having a closure element.

* * * * *